US010865751B2

(12) United States Patent
Herrmann et al.

(10) Patent No.: US 10,865,751 B2
(45) Date of Patent: Dec. 15, 2020

(54) HIGH-PRESSURE FUEL PUMP

(71) Applicant: Robert Bosch GmbH, Stuttgart (DE)

(72) Inventors: Jan Herrmann, Stuttgart (DE); Sebastian Bauer, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/315,329

(22) PCT Filed: May 10, 2017

(86) PCT No.: PCT/EP2017/061214
§ 371 (c)(1),
(2) Date: Jan. 4, 2019

(87) PCT Pub. No.: WO2018/007055
PCT Pub. Date: Jan. 11, 2018

(65) Prior Publication Data

US 2019/0301415 A1 Oct. 3, 2019

(30) Foreign Application Priority Data

Jul. 8, 2016 (DE) ..... 10 2016 212 458

(51) Int. Cl.
*F02F 7/00* (2006.01)
*F02M 59/44* (2006.01)
*F02M 55/04* (2006.01)

(52) U.S. Cl.
CPC ..... *F02M 59/44* (2013.01); *F02M 55/04* (2013.01); *F02M 2200/315* (2013.01)

(58) Field of Classification Search
CPC .. F02M 59/445; F02M 59/44; F02M 2200/09; F04B 11/0016; F04B 53/16
USPC ..... 123/195 R, 195 C
See application file for complete search history.

(56) References Cited

U.S. PATENT DOCUMENTS

| | | | | |
|---|---|---|---|---|
| 2009/0044783 | A1 | 2/2009 | Fischer et al. | |
| 2016/0115953 | A1 | 4/2016 | Kuroyanagi et al. | |
| 2019/0032615 | A1* | 1/2019 | Haupt | F02M 55/04 |
| 2019/0048837 | A1* | 2/2019 | Mikhaylov | F02M 59/025 |
| 2019/0285032 | A1* | 9/2019 | Loscrudato | F02M 55/04 |

FOREIGN PATENT DOCUMENTS

| | | | |
|---|---|---|---|
| DE | 103 27 408 | A1 | 4/2004 |
| DE | 10 2007 038 984 | A1 | 2/2009 |
| JP | 2004-138071 | A | 5/2004 |
| JP | 2010-180727 | A | 8/2010 |
| JP | 2011-144700 | A | 7/2011 |

(Continued)

OTHER PUBLICATIONS

International Search Report corresponding to PCT Application No. PCT/EP2017/061214, dated Jul. 7, 2017 (German and English language document) (7 pages).

*Primary Examiner* — John Kwon
(74) *Attorney, Agent, or Firm* — Maginot, Moore & Beck LLP

(57) ABSTRACT

A high-pressure fuel pump includes a pump housing and a cover element. The cover element is connected to the pump housing and has a wall. A damping volume is arranged between the cover element and the pump housing. The wall has a reinforcement, which is formed such that a resonant frequency of the cover element lies above 9 kHz, preferably above 11 Hz, in particular above 12 kHz.

18 Claims, 4 Drawing Sheets

(56) References Cited

FOREIGN PATENT DOCUMENTS

| | | | |
|---|---|---|---|
| JP | 2012-117471 | A | 6/2012 |
| JP | 2014-167297 | A | 9/2014 |
| JP | 2015-083841 | A | 4/2015 |
| JP | 2015-086699 | A | 5/2015 |
| JP | 2015-232283 | A | 12/2015 |
| JP | 2016-035268 | A | 3/2016 |
| JP | 2016-061246 | A | 4/2016 |
| WO | 2016/042853 | A1 | 3/2016 |

* cited by examiner

HIGH-PRESSURE FUEL PUMP

This application is a 35 U.S.C. § 371 National Stage Application of PCT/EP2017/061214, filed on May 10, 2017, which claims the benefit of priority to Serial No. DE 10 2016 212 458.7, filed on Jul. 8, 2016, in Germany, the disclosures of which are incorporated herein by reference in their entirety.

BACKGROUND

The disclosure relates to a high-pressure fuel pump.

Fuel systems for internal combustion engines are known on the market in which fuel from a fuel tank is conveyed at high pressure into a high-pressure accumulator ("rail") by means of a predelivery pump and a mechanically driven high-pressure fuel pump. A damper device is normally arranged on or in a pump housing of a high-pressure fuel pump of said type. A damper device of said type normally comprises a cover element and a membrane damper arranged between cover element and pump housing, which membrane damper is normally designed as a gas-filled membrane capsule and is supported by means of a holding element on the pump housing and is arranged so as to be spaced apart from said pump housing in a vertical direction. The damper device is in this case fluidically connected to a low-pressure region. The damper device serves for damping pressure pulsations in the low-pressure region of the fuel system, which pressure pulsations are caused for example by opening and closing processes of valves, for example of an inlet valve, in the high-pressure fuel pump.

SUMMARY

It is an object of the disclosure to provide a high-pressure fuel pump, the operation of which has little disturbing effect on vehicle occupants.

Said object is achieved by means of a high-pressure fuel pump. By means of the high-pressure fuel pump according to the disclosure, it is ensured that vibrations of the cover element that occur during the operation of the high-pressure fuel pump for example owing to generation of noise in the event of impacts of a plunger that actuates a flow control valve result in only low noise emissions, or that the noise emissions radiated by the cover element are not perceived as disturbing by the vehicle occupants.

It is preferable if a stiffening of a wall of the cover element is at any rate also formed by virtue of curved regions of the wall which run at least also in a radial direction having a respective center of curvature on the side of the damping volume. In other words: such a section of the wall which overall runs substantially or at least also in a radial direction is concavely curved as viewed from the damping volume (or from the "focal point" if the section of the wall were a lens). Here, it is preferred if said curved profile of the wall forms the stiffening. A center of curvature on the side of the damping volume means that the central point of a local curvature circle (also referred to as osculating circle) is situated on the side of the damping volume. The curvature circle at a respective point of the wall is in this case the circle that best approximates the profile of the wall at said point, and which thus locally osculates the profile of the wall. A tangent of the curvature circle at said point corresponds to the tangent of the wall. Here, a point on the wall may have different curvature circles depending on the section plane (the section planes to be considered are arranged in each case parallel to a piston longitudinal axis). The wall curved in this way has a self-stabilizing effect, whereby the cover element, while having a small material thickness and thus a low weight, small structural size and compact dimensions, exhibits high stiffness and thus resistance to vibrations.

It is however also pointed out at this juncture that the stiffening may also be produced in an entirely different manner, for example through the formation of stiffening ribs, through corresponding selection of the material thickness and/or a corresponding selection of the material mass of the wall.

It is preferable if the cover element is part of a damper device which comprises a membrane damper, which is arranged between cover element and pump housing, preferably a holding element, by means of which the membrane damper is supported on the pump housing and is arranged spaced apart in a vertical direction from the pump housing, and preferably a spring element, by means of which the membrane damper is supported on the cover element and is arranged spaced apart in the vertical direction from said cover element. By virtue of the cover element being formed as part of the damper device just described, pressure oscillations during the operation of the high-pressure fuel pump according to the disclosure can be advantageously damped.

It is also advantageous if the cover element has a first section, which runs axially overall, and a second section, which runs in a radial direction. In this way, the damping volume is realized in a simple manner. Here, the vibration behavior of the cover element during the operation of the high-pressure fuel pump is advantageously influenced, such that particularly low noise emissions occur, with high damping capacity during the operation of the high-pressure fuel pump. With regard to the second section, "running in a radial direction" means that said second section has, in its profile, a component which points in the radial direction, that is to say the second section need not run entirely in the radial direction. This feature thus also encompasses a second section which runs obliquely in a radial and axial direction.

It is advantageous here if the axially running first section of the cover element has, at its end averted from the second section, a radially internally situated beveled region for the joining to the pump housing. In this way, the cover element can be advantageously joined to the pump housing, and fastened to the pump housing for example by means of a capacitor discharge press-fit welding process. It is preferable here if the radially internally situated beveled region of the cover element surrounds a part of the pump housing in a radial direction. In this way, the cover element can be easily fastened to the pump housing.

It is also preferable if the second section—that is to say that section of the wall which runs overall, or at least also, in a radial direction and which is concave overall as viewed from the damping volume (or from the focal point if the section of the wall were a lens)—comprises a transition region, which has a cross section with a first inner curvature radius of between 2 mm to 10 mm, preferably between 5 mm to 9 mm, preferably between 6 mm to 8 mm, in particular between 6.5 mm to 7.5 mm, in particular of 7 mm, and a main region, which has a cross section with a second inner curvature radius of between 40 mm to 54 mm, preferably between 42 mm to 52 mm, preferably between 44 mm to 50 mm, in particular between 46 mm to 48 mm, in particular of 47 mm, wherein the second section is preferably composed of the transition region and the main region. In this way, it is achieved in a particularly simple and easily producible manner that modes of vibration or resonance frequencies of the cover are such that an advantageous spectrum of noise emissions or noise radiation occurs during the operation of the pump, which is not perceived, or is not perceived as being unpleasant, by the user of a vehicle in which the high-pressure fuel pump is installed.

It is also advantageous if the first section, which runs axially overall, of the cover element has an axial extent of at least 5 mm, preferably of at least 6 mm, preferably of at least 7 mm, in particular of at least 8 mm and/or of at most 12 mm, preferably of at most 11 mm, preferably of at most 10 mm, in particular of at most 9 mm. Such a cover element offers sufficient space for accommodating further parts of the damper device between cover element and pump housing, for example the abovementioned membrane damper. Nevertheless, the structural height is relatively small overall, and the resonance behavior is such that undesired noise emissions are suppressed in an effective manner.

It is also advantageous if the second section, which runs overall substantially radially, of the wall of the cover element has, as viewed in an axial direction, an extent of at least 7 mm, preferably of at least 8 mm, preferably of at least 9 mm, in particular of at least 9.5 mm and/or of at most 13 mm, preferably of at most 12 mm, preferably of at most 11 mm, in particular of at most 10.5 mm. The greater the axial extent of the second section, the more intensely curved the second section can be designed to be, which leads to a particularly effective suppression of noise emissions, but has an adverse effect on the required structural height of the high-pressure fuel pump. The abovementioned ranges represent an advantageous compromise solution between noise suppression and space-saving structural height of the high-pressure fuel pump according to the disclosure.

It is also advantageous if a wall thickness of the cover element in a radially inner region amounts to at least 1.5 mm, preferably at least 1.6 mm, preferably at least 1.65 mm, wherein the inner region is arranged around a central axis of the cover element and has, in a radial direction, a diameter of at least 41 mm, preferably 41.7 mm, preferably 43 mm, in particular 45 mm. The stated minimum cover thickness in the radially inner region leads to an adequate degree of suppression of vibrations of the cover element which cause noises during the operation of the high-pressure fuel pump. The stated values for the wall thickness permit inexpensive production of the cover while realizing a small installation size and reasonable weight of the high-pressure fuel pump, but with simultaneously adequate suppression of noise emissions.

It is also advantageous if the cover element has an axial extent of at least 15 mm, preferably of at least 16 mm, preferably of at least 17 mm, in particular of at least 18 mm, and/or an axial extent of at most 22 mm, preferably of at most 21 mm, preferably of at most 20 mm, in particular of at most 19 mm. The described lower limits represent advantageous values which make it possible, for example, for the membrane damper, the holding element and/or the spring element, as described above, to be arranged between cover element and pump housing, wherein the stated maximum values ensure an advantageous small structural height of the high-pressure fuel pump.

BRIEF DESCRIPTION OF THE DRAWINGS

Further features, possible uses and advantages of the disclosure will emerge from the following description of exemplary embodiments of the disclosure, which will be discussed on the basis of the drawing, wherein the features may be of importance to the disclosure both individually and in a wide variety of combinations, without this being explicitly pointed out again. In the drawing.

DETAILED DESCRIPTION

Figure 1:
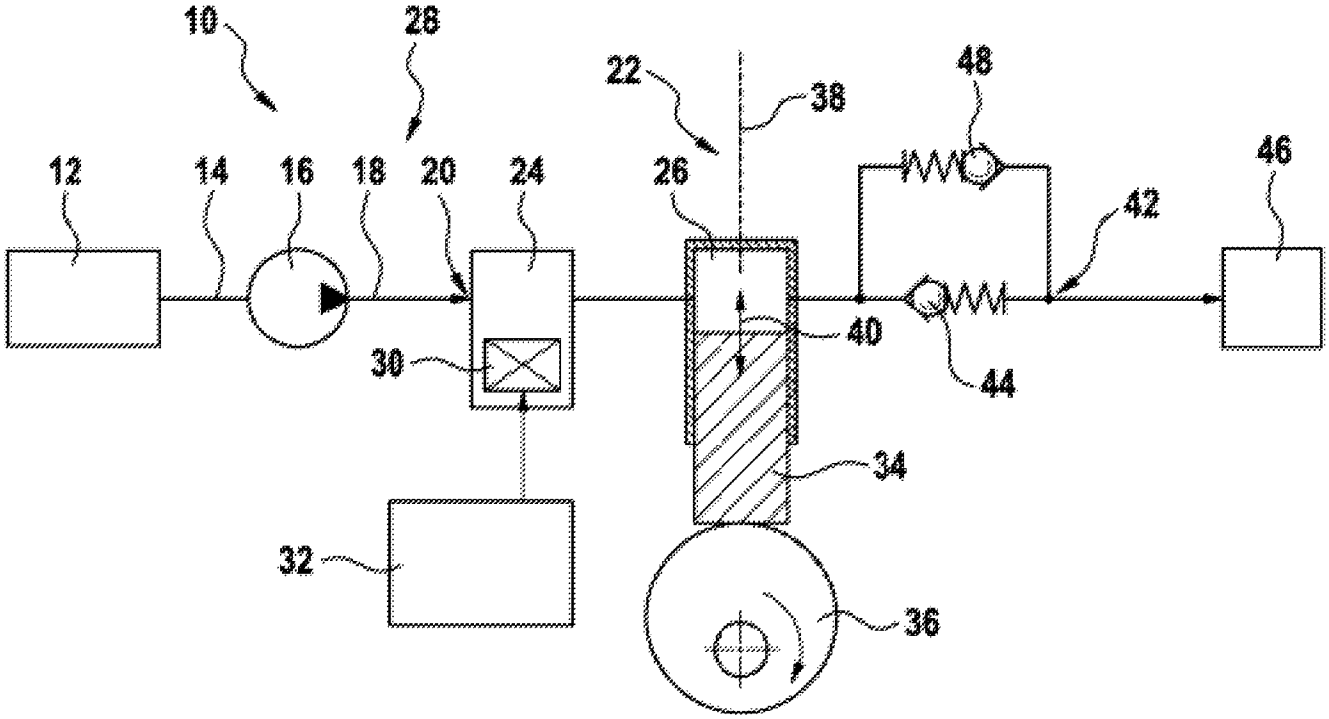
FIG. 1 is a simplified schematic illustration of a fuel system for an internal combustion engine.

FIG. 1 shows a fuel system 10 for an internal combustion engine (not illustrated in any more detail) in a simplified schematic illustration. During the operation of the fuel system 10, fuel from a fuel tank is fed via a suction line 14 and by means of a predelivery pump 16 and a low-pressure line 18 via an inlet 20 of a high-pressure fuel pump 22 designed as a piston pump. In the inlet 20, there is arranged an inlet valve 24, by means of which a piston chamber 26 is fluidically connectable to a low-pressure region 28 which comprises the predelivery pump 16, the suction line 14 and the fuel tank 12. Pressure pulsations in the low-pressure region 28 can be damped by means of a pressure damper device 29. This will be discussed in more detail further below. The inlet valve 24 can be positively opened by means of an actuating device 30. The actuating device 30 and thus the inlet valve 24 are activatable by means of a control unit 32.

A piston 34 of the high-pressure fuel pump 22 can be moved upward and downward along a piston longitudinal axis 38, as indicated by an arrow with the reference designation 40, by means of a drive 36 which is designed in the present case as a cam disk. Arranged hydraulically between the piston chamber 26 and an outlet connector 42 of the high-pressure fuel pump 22 is an outlet valve 44 which can open in the direction of a high-pressure accumulator 46 ("rail"). The high-pressure accumulator 46 and the piston chamber 26 are fluidically connectable by means of a pressure-limiting valve 48, which opens in the event of a threshold pressure being exceeded in the high-pressure accumulator 46.

The high-pressure accumulator 46 and the piston chamber 26 are fluidically connectable by means of a pressure-limiting valve 48, which opens in the event of a threshold pressure being exceeded in the high-pressure accumulator 46. The pressure-limiting valve 48 is designed as a spring-loaded check valve and can open in the direction of the piston chamber 26.

Figure 2:
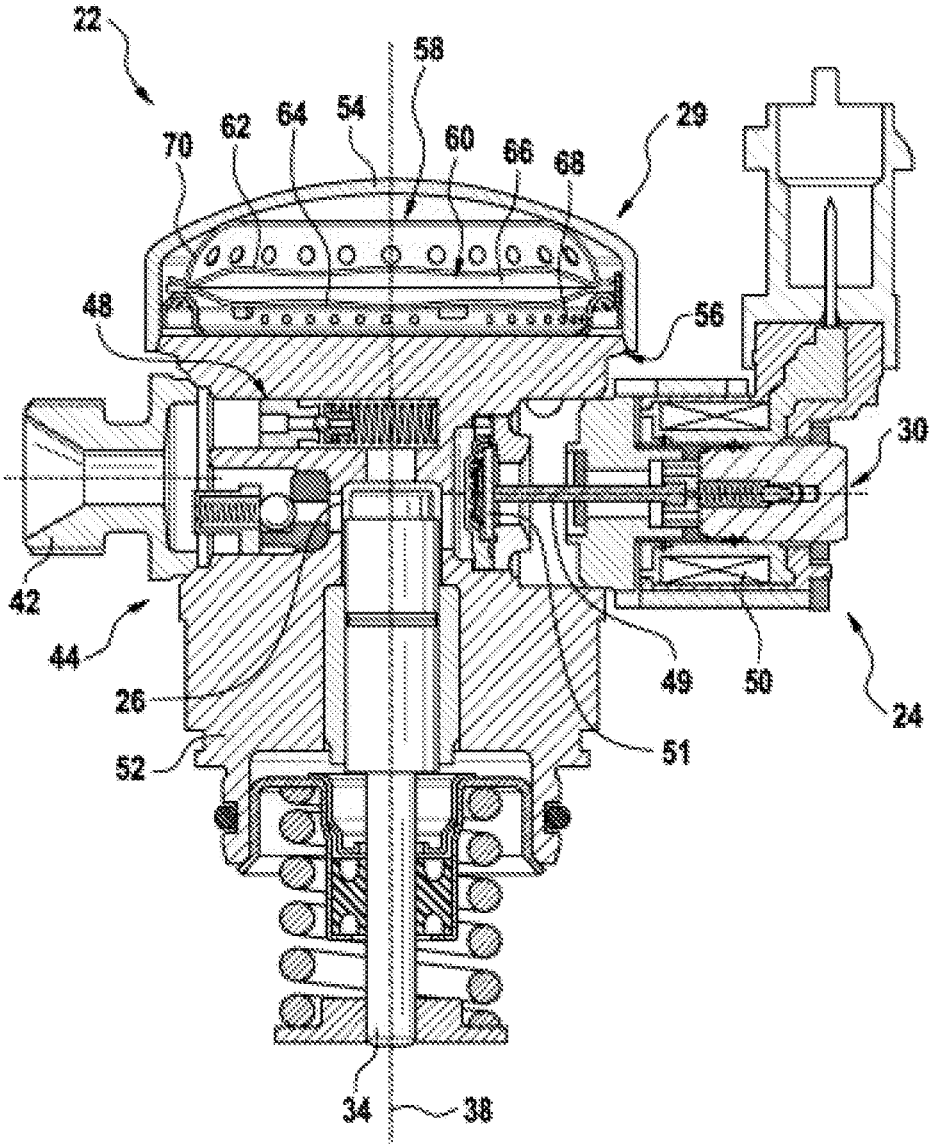
FIG. 2 is a sectional illustration of a high-pressure fuel pump according to the disclosure.

The high-pressure fuel pump 22 is shown in a sectional illustration in FIG. 2. In the illustration of FIG. 2, it can be seen that the actuating device 30 comprises a spring-loaded plunger 49. The plunger 49 is movable by means of a magnet coil 50 and can positively open a likewise spring-loaded valve body 51 of the inlet valve 24.

In the illustration of FIG. 2, the pressure damper device 29 is arranged in the upper region of the high-pressure fuel pump 22. The pressure damper device 29 comprises a pot-like cover element 54, which is connected to the pump housing 52 in a connecting region 56, specifically in the present case by means of a capacitor discharge press-fit weld seam. The connecting region 56 runs in a circumferential direction around the pump housing 52.

The pump housing 52 and the cover element 54 delimit an interior space 58 of the pressure damper device 29. A membrane damper 60 is arranged in the interior space 58 of the pressure damper device 29. Said membrane damper comprises a first, and in the figures upper, membrane 62 and a second, and in the figures lower, membrane 64, which are welded to one another at the edge. The upper membrane 62 and the lower membrane 64 enclose a damping volume 66, which is filled with gas and compressible, because the two membranes 62 and 64 each constitute flexible walls for the damping volume 66.

The membrane damper 60 is supported at the edge, via a support element 68, on the pump housing 52, and is arranged so as to be spaced apart in an axial, or in the figures vertical, direction along the piston longitudinal axis 38. A spring element 70 is arranged, so as to be situated opposite the support element 68, between membrane damper 60 and cover element 54. Via the spring element 70, the membrane damper 60 is supported on the cover element 54 and is arranged so as to be spaced apart from the latter in the axial direction 38. Overall, the membrane damper 60 is braced at the edge between the cover element 54 and the pump housing 52 via the support element 68 and the spring element 70.

During the operation of the high-pressure fuel pump 22, the fuel in the low-pressure region 28 is caused to exhibit pressure pulsations. Said pressure pulsations can be compensated by compression and decompression of the membrane damper 60.

The cover element 54 will be discussed in more detail below with reference to FIG. 3. The piston longitudinal axis 38 shown in FIG. 2 corresponds, in FIG. 3, to a central axis 38 of the cover element 54. The cover element 54 has a wall 72. The wall 72 of the cover element 54 has a first section 74, which in FIG. 3 runs entirely vertically, that is to say whose profile lies entirely in the direction of the piston longitudinal axis 38. The wall 72 of the cover element also has a second section 76, which adjoins the first section 74 and which runs overall and substantially in a radial direction 78. This means that the second section 76 runs not only in a radial direction (arrow 78 in FIG. 3) but also somewhat in an axial direction. The second section 76 is bulged away from the interior space 58, is of concave form as viewed from the interior space 58 (or from the focal point if the second section 26 were a lens), and is thus curved such that a center of curvature of the local curvature is situated on the side of the interior space 58, whereby a stiffening of the cover element 54 or the wall 72 thereof is formed.

At its end of the first section 74 averted from the second section 76, the radial section 74 has a radially beveled region 80 which serves for the joining to the pump housing 52. The second section 76 has, in the direction of the first section 74, a transition region 82 with a first inner curvature radius 84, which in the present case amounts to 7 mm. The second section 76 furthermore has a main region 86, which adjoins the transition region 82 in a radially inward direction and which has a cross section with a second inner curvature radius 88, wherein the second inner curvature radius 88 amounts in the present case to 47 mm.

In the present case, the second section 76 is composed of the transition region 78 and the main region 86. An inner region of the cover element is denoted in FIG. 3 by the reference designation 90. In the inner region 90, the wall 72 of the cover element 54 has a wall thickness 92, which in the present case amounts to 1.65 mm. In the present case, the inner region 90 has a diameter around the piston longitudinal axis 38 of 41.7 mm.

Figure 3:
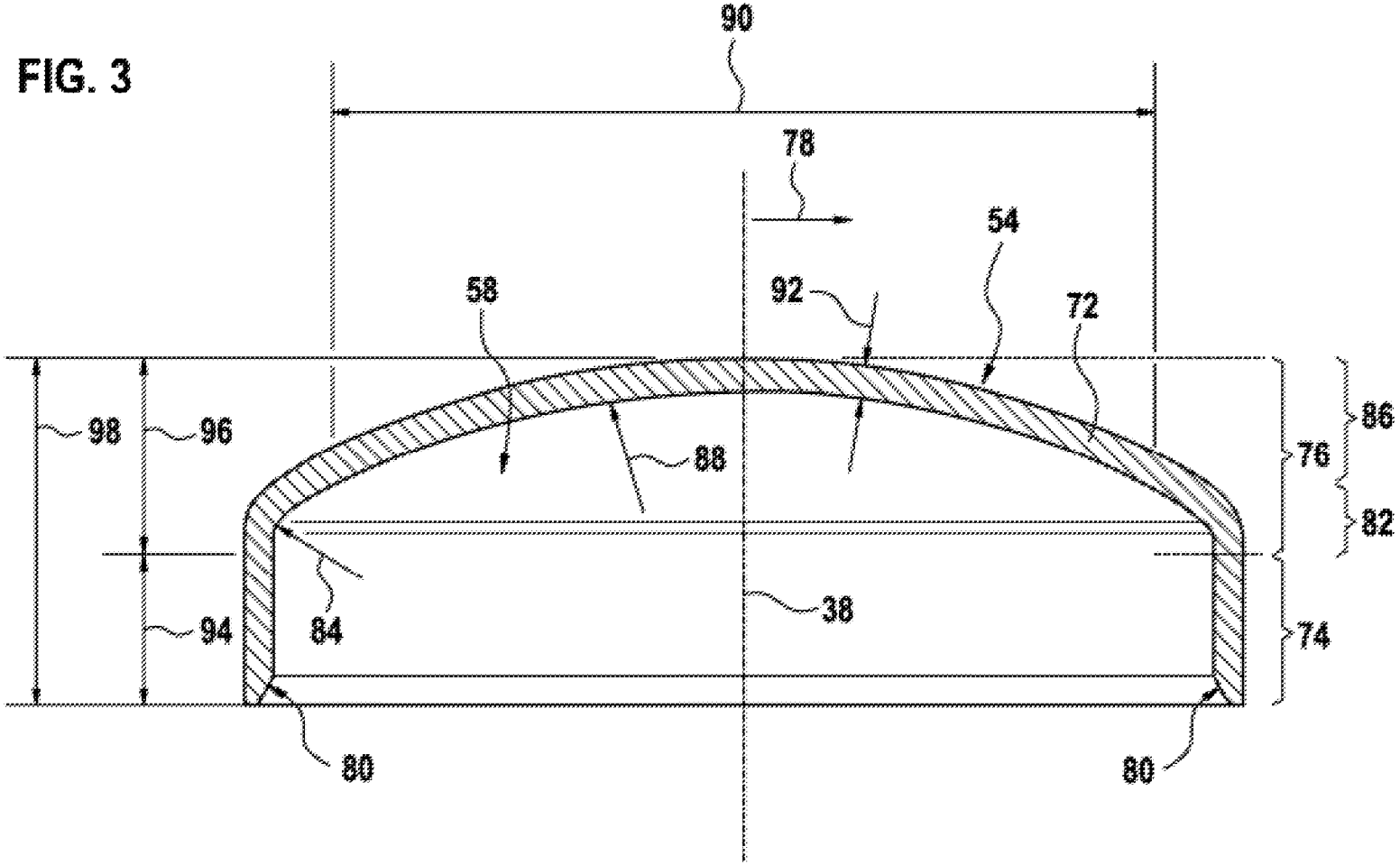
FIG. 3 shows an individual enlarged illustration of a cover element of the high-pressure fuel pump from FIG. 2 in detail.

An axial extent of the first section bears the reference designation 94 in FIG. 3, and amounts in the present case to 8.2 mm. A vertical extent of the second section 76 bears the reference designation 96 in FIG. 3, and amounts in the present case to 9.9 mm. Consequently, an overall vertical extent 98 of the cover element 54 amounts in the present case to 18.1 mm. Sections of the wall 72 running in a radial direction, that is to say in the present case the second section 76, are of concave form with respect to the interior space 58.

During the operation of the inlet valve 24, the latter is, in part, positively opened, or prevented from closing, by the plunger 49. In this way, the amount of fuel conveyed through the high-pressure fuel pump 22 can be adjusted. If the plunger 49 strikes the valve body 51 of the inlet valve 24, this causes a noise. Said noise propagates through the pump housing 52 or through the fuel to the cover element 54, whereby said cover element can be caused to vibrate. The cover element 54 then radiates these noises. If the modes of vibration of the cover element 54 were to lie, for example, in the range around 8000 Hz, disadvantageous amplification of the noise emission could occur. Owing to the geometry of the cover element 54 just described, the modes of vibration of the cover element 54 are close to the inaudible range or in the inaudible range, in particular in the range from 12,000 Hz-13,000 Hz. This has an advantageous effect on the noise emissions during the operation of the high-pressure fuel pump 22 according to the disclosure, because said noise emissions are either of a high frequency or are directly in the inaudible range.

Figure 4:
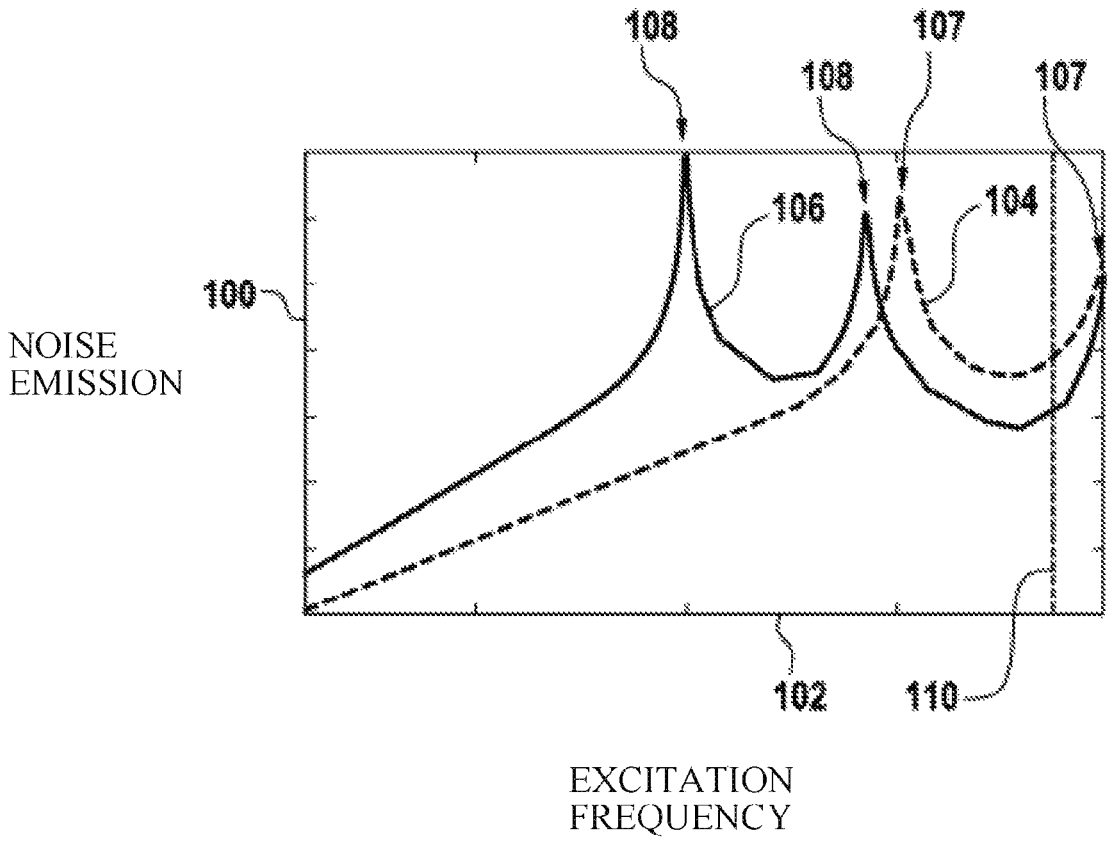
FIG. 4 shows a diagram illustrating the resonance frequency of the cover element from FIG. 2 and FIG. 3 in detail and a comparison with the resonance frequency of a conventional high-pressure fuel pump.

FIG. 4 illustrates the noise emission 100 as a function of the excitation frequency 102. Here, the resonance behavior of the high-pressure fuel pump 22 according to the disclosure is denoted by the reference designation 104 and is plotted as a dashed line, and the resonance behavior of a high-pressure fuel pump 22 known from the prior art is denoted by the reference designation 106 and is plotted as a solid line. The resonance frequencies 107 of the high-pressure fuel pump 22 according to the disclosure have been shifted in the direction of the inaudible range 110 in relation to the resonance frequencies 108 of the prior art. Also, the overall level of noise emission 100 (sound intensity) at the resonance frequencies 107 is lower than in the case of the resonance frequencies 108 of the high-pressure fuel pump 22 known from the prior art.

The invention claimed is:

1. A high-pressure fuel pump, comprising:

a pump housing defining a fluid inlet and a separate fluid outlet; and a cover element connected to the pump housing and including a wall, wherein a damping volume is arranged between the cover element and the pump housing, wherein the wall includes a stiffening element configured such that a resonance frequency of the cover element is above 9 kHz, and wherein the stiffening element is formed by curved regions of the wall, the curved regions running at least in a radial direction and including a respective center of curvature positioned on a side of the cover element that faces the damping volume.

2. The high-pressure fuel pump as claimed in claim 1, further comprising:

a damper device including:

the cover element;

a membrane damper arranged between the cover element and the pump housing;

a support element configured to support the membrane damper on the pump housing and spaced apart in a vertical direction from the pump housing; and a spring element configured to support the membrane damper on the cover element and spaced apart in the vertical direction from the cover element.

3. The high-pressure fuel pump as claimed in claim 1, wherein the wall of the cover element includes a first section that runs in an axial direction, and a second section that runs substantially in the radial direction.

4. The high-pressure fuel pump as claimed in claim 3, wherein the first section of the wall includes an axial extent of at least 5 mm.

5. The high-pressure fuel pump as claimed in claim 4, wherein the axial extent is less than or equal to 12 mm.

6. The high-pressure fuel pump as claimed in claim 3, wherein:

the second section of the wall includes:

a radially outer transition region having a first cross section with a first inner curvature radius between 4 mm to 10 mm; and a radially inner main region having a second cross section with a second inner curvature radius between 40 mm to 54 mm; and the second section includes the radially outer transition region and the radially inner main region.

7. The high-pressure fuel pump as claimed in claim 3, wherein the second section of the wall includes a further extent in the axial direction of at least 7 mm.

8. The high-pressure fuel pump as claimed in claim 7, wherein the further extent is less than or equal to 13 mm.

9. The high-pressure fuel pump as claimed in claim 3, wherein:

a wall thickness of the wall in a radially inner second region of the second section is at least 1.5 mm; and the radially inner second region is arranged around a central axis of the cover element and, in the radial direction, has a diameter of at least 41 mm.

10. The high-pressure fuel pump as claimed in claim 3, wherein:

the second section of the wall includes (i) a transition region that adjoins the first section and (ii) a main region that runs between the transition region and a central axis of the cover element, and the main region, when viewed radially inwardly from the transition region to the central axis, includes a further extent that continuously extends away from the pump housing in the axial direction.

11. The high-pressure fuel pump as claimed in claim 3, wherein the second section of the wall is continuously curved along an entire extent of the second section between the first section and a central axis of the cover element.

12. The high-pressure fuel pump as claimed in claim 1, wherein the cover element includes an overall extent in an axial direction of at least 15 mm, and/or a vertical extent of at most 22 mm.

13. The high-pressure fuel pump as claimed in claim 1, wherein the resonance frequency is above 11 kHz.

14. The high-pressure fuel pump as claimed in claim 1, wherein the wall of the cover element is a contiguous wall and includes (i) a first section that runs exclusively in an axial direction and (ii) a second section that adjoins a first end of the first section and runs substantially radially inwardly to a central axis of the cover element, the cover element joined to the pump housing at a second end of the first section averted from the first end.

15. The high-pressure fuel pump as claimed in claim 14, wherein the second end of the first section of the wall includes a radially internally situated beveled region, the cover element joined to the pump housing along the radially internally situated beveled region.

16. A high-pressure fuel pump, comprising:

a pump housing; and a cover element connected to the pump housing and including a wall, the wall and the pump housing defining a damping volume encompassed therebetween, wherein the wall includes a stiffening element configured such that a resonance frequency of the cover element is above 9 kHz, wherein the stiffening element is formed by curved regions of the wall that overlap the damping volume in an axial direction, the curved regions all including a respective center of curvature positioned on a side of the cover element that faces the damping volume, wherein the wall of the cover element includes a first section that runs in an axial direction, and a second section that runs substantially in the radial direction, and wherein the second section of the wall is continuously curved along an entire extent of the second section between the first section and a central axis of the cover element.

17. A high-pressure fuel pump, comprising:

a pump housing; and a cover element having a wall, the wall connected to the pump housing so as to define a damping volume therebetween, wherein the wall includes a stiffening element configured such that a resonance frequency of the cover element is above 9 kHz, and wherein the wall of the cover element includes (i) a first section that adjoins the pump housing and extends axially away from the pump housing and (ii) a second section that adjoins the first section and extends radially inwardly to a central axis of the cover element, the second section bulging away from the damping volume along an entire radial extent between the first section and the central axis so as to form the stiffening element.

18. The high-pressure fuel pump as claimed in claim 1, wherein the fluid outlet does not open to the damping volume.

* * * * *